US009567820B2

(12) United States Patent
Pearl et al.

(10) Patent No.: US 9,567,820 B2
(45) Date of Patent: Feb. 14, 2017

(54) TUBULAR SYSTEM FOR JET DRILLING

(71) Applicant: Buckman Jet Drilling Inc., Bowling Green, KY (US)

(72) Inventors: Zachary D. Pearl, Bowling Green, KY (US); William G. Buckman, Sr., Bowling Green, KY (US); William C. Maurer, Austin, TX (US); Thomas N. Garmon, Bowling Green, KY (US)

(73) Assignee: Buckman Jet Drilling Inc., Bowling Green, KY (US)

( * ) Notice: Subject to any disclaimer, the term of this patent is extended or adjusted under 35 U.S.C. 154(b) by 374 days.

(21) Appl. No.: 14/243,028

(22) Filed: Apr. 2, 2014

(65) Prior Publication Data

US 2014/0299324 A1 Oct. 9, 2014

Related U.S. Application Data

(60) Provisional application No. 61/853,615, filed on Apr. 9, 2013.

(51) Int. Cl.

| | |
|---|---|
| ***E21B 29/06*** | (2006.01) |
| ***E21B 7/08*** | (2006.01) |
| ***E21B 7/18*** | (2006.01) |
| ***E21B 17/20*** | (2006.01) |
| ***E21B 41/00*** | (2006.01) |
| ***E21B 7/06*** | (2006.01) |

(52) U.S. Cl.

CPC ..... *E21B 29/06* (2013.01); *E21B 7/061* (2013.01); *E21B 7/18* (2013.01); *E21B 17/20* (2013.01); *E21B 41/0035* (2013.01)

(58) Field of Classification Search

CPC ..... E21B 17/20; E21B 29/06; E21B 7/061; E21B 7/18; E21B 41/0035

See application file for complete search history.

(56) References Cited

U.S. PATENT DOCUMENTS

| | | | | |
|---|---|---|---|---|
| 2,345,816 | A * | 4/1944 | Hays | E21B 7/061 175/206 |
| 3,191,697 | A * | 6/1965 | Haines | C09K 8/72 175/424 |
| 5,413,184 | A | 5/1995 | Landers | |
| 5,853,056 | A * | 12/1998 | Landers | E21B 7/061 166/117.5 |
| 6,125,949 | A * | 10/2000 | Landers | E21B 7/061 175/424 |
| 6,189,629 | B1 * | 2/2001 | McLeod | E21B 7/061 175/321 |
| 6,257,353 | B1 * | 7/2001 | Belew | E21B 7/061 175/2 |
| 6,668,948 | B2 | 12/2003 | Buckman | |
| 6,915,853 | B2 * | 7/2005 | Bakke | E21B 7/18 166/298 |
| 6,920,945 | B1 * | 7/2005 | Belew | E21B 7/061 166/298 |

(Continued)

*Primary Examiner* — Blake Michener
(74) *Attorney, Agent, or Firm* — Tumey L.L.P.

(57) ABSTRACT

Apparatus and method for drilling a drain hole from a well are provided. A flexible tubing used for conveying fluid to a jet bit is confined radially by a reduced-diameter tubing piece or a liner in production tubing near the diverter used to direct the flexible tubing. Concentric tubing pieces allow location of the bit in a well by measuring weight of a work string.

16 Claims, 6 Drawing Sheets

(56) References Cited

U.S. PATENT DOCUMENTS

| | | | | |
|---|---|---|---|---|
| 7,168,491 | B2 * | 1/2007 | Malone | E21B 7/061 166/298 |
| 7,971,658 | B2 * | 7/2011 | Buckman, Sr. | E21B 7/18 175/424 |
| 2009/0107678 | A1 * | 4/2009 | Buckman, Sr. | E21B 7/18 166/297 |
| 2012/0061079 | A1 * | 3/2012 | Buckman, Sr. | E21B 29/06 166/298 |
| 2014/0054092 | A1 * | 2/2014 | Buckman, Sr. | E21B 7/18 175/107 |
| 2015/0285002 | A1 * | 10/2015 | Dawson | E21B 41/0035 175/62 |

* cited by examiner

TUBULAR SYSTEM FOR JET DRILLING

This application claims priority to U.S. Provisional Application Ser. No. 61/853,615, filed Apr. 9, 2013.

BACKGROUND OF INVENTION

1. Field of the Invention

This invention relates to jet drilling drain holes from well bores, primarily in oil and gas wells.

2. Description of Related Art

Oil and gas wells are usually drilled vertically and cased with steel pipe. Typical casing pipes are from 4.5 to 8 inches in diameter. In a typical short-radius jet drilling technique, a flexible tubing or hose attached to the bottom of small rigid tubing (work string) turns 90 degrees within a channel in a diverter attached to a larger (production) tubing inside the casing. Fluid is pumped through the work string, flexible tubing and a bit on the flexible tubing to drill drain holes that may extend 15 to 100 ft. or more from the casing into the rock formation. The drain holes allow more contact area with the rock formation, increasing the flow capacity of the well. Buckman (U.S. Pat. No. 6,668,948), Landers (U.S. Pat. No. 5,413,184) and others have developed short-radius drilling systems that have a radius of 4 inches or less, in which a jet bit (nozzle) and hose pass down through a tubing string in a vertical well to a diverter, which contains a path to deviate the jet bit and flexible hose to enable drilling deviated or horizontal laterals or drain holes in oil and gas wells.

There are limiting factors that can prevent a flexible hose from passing through a tight 90-degree turn in a 4-inch radius. Like coiled tubing, a flexible hose can sinusoidally, helically buckle, causing extra friction or drag. Reduction of friction between a flexible hose and surrounding pipe can allow more force to be applied at a bit. Excess friction may lead to "lockup." When lockup occurs, no matter how much force is applied the tubing can no longer move. If excessive force is continually applied from above in a larger tubular (well tubing) having sufficient diameter, the work string and the flex hose can "pass by itself," meaning that the flexible tubing turns enough to pass alongside the work string and inside the larger (production) tubing. In this condition, an observation at the surface of the work string rapidly going down the production tubing creates the illusion of jet drilling of the formation while the jet bit is not moving.

Another problem in conventional short-radius drilling is that a jet bit may "catch" inside threaded connections of jointed production tubing. If this occurs during the deployment of the jet bit and flex hose downhole, it has been observed that it is near impossible to complete the trip of the bit to the diverter.

A further problem is knowing when the jet bit is at the diverter and then in a position to be engaged at the formation. Without simple and precise knowledge of formation engagement one can falsely claim the drilling of a formation.

Method and apparatus are needed to eliminate the jet bit catching on tubing connections as it is inserted through the tubing down the well. A signal or indication at the surface is also needed when the jet bit encounters the diverter and the formation, and a technique to transmit greater axial force to the jet bit as it passes through the diverter and jet drills is needed.

BRIEF SUMMARY OF THE INVENTION

In one embodiment, a tubular system having an inner and outer pipe, the outer pipe enclosing an inner pipe and a flexible hose with a jet bit, is provided. The inner pipe is allowed to move freely a desired distance as the flexible hose and jet bit drill out into a formation. The tubular system also assures that the jet bit will not catch on the gaps in connections of the production tubing as the tubular system is placed in a well. A work string (coiled or jointed tubing) is used to place the tubular system in a well. A decrease in the work string weight at the surface will signal delivery of the outer tube to the diverter and then the jet bit can be lowered through the diverter. Because of a smaller-diameter confining tubular around the flexible hose, i.e., a "close-fitting tubular system," the system assures minimum buckling of the flexible hose as the jet bit passes through the diverter and jet drills a lateral into a reservoir. Fluids may be used that are selected to reduce metal-to-metal frictional drag of the flexible tubing and other tubulars in the wellbore.

In another embodiment, a close-fitting tubular system is provided by installing a liner inside the production tubing before it is placed in a well with the diverter. In this embodiment, the bit is not enclosed as the flexible tubing and bit are placed in the well and the bit may catch in connections in the tubing. A soluble or degradable ball on the bit may be used to keep the bit from catching in the tubing gaps as it is being lowered. The close-fitting liner located above the diverter enables the hose to push the jet bit through the diverter and into the formation with significantly less buckling and frictional forces. The liner may be formed from a low-friction solid and fluids may be used that are selected to reduce metal-to-metal frictional drag of the flexible tubing and other tubulars in the wellbore.

BRIEF DESCRIPTION OF THE SEVERAL VIEWS OF THE DRAWING(S)

For a more complete understanding of the present invention and the advantages thereof, reference is now made to the following description taken in conjunction with the accompanying drawings in which like reference numbers indicate like features and wherein.

DETAILED DESCRIPTION OF THE INVENTION

Figure 1:
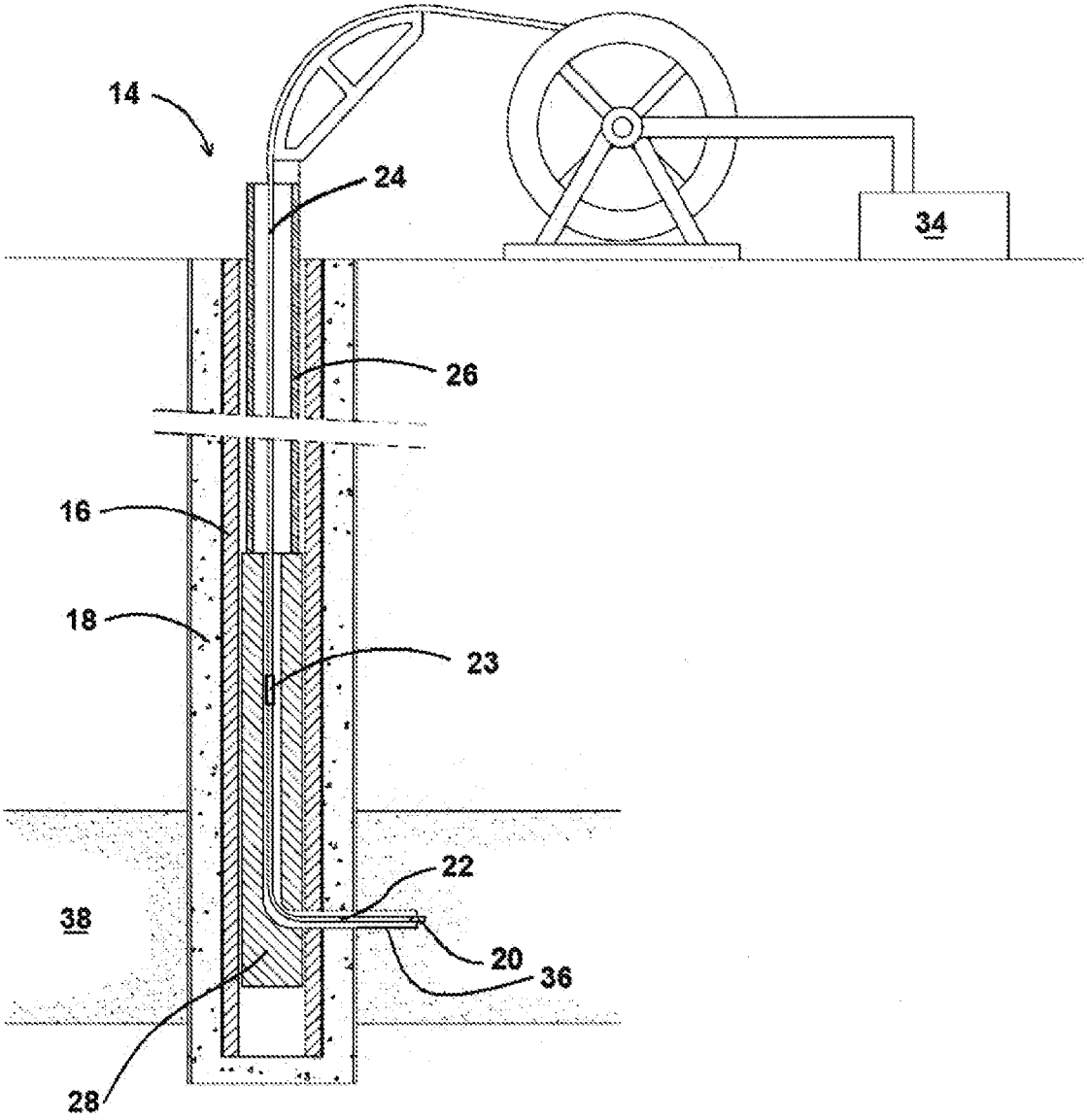
FIG. 1 illustrates a cased well and drilling apparatus provided herein for drilling through a casing and drilling a drainhole in a reservoir.

Referring to FIG. 1, one embodiment of drilling apparatus, such as disclosed in U.S. Pat. No. 6,668,948, which is hereby incorporated by reference for all purposes, is illustrated. Jet bit 20 has been used to jet drill lateral or drain hole 36 into formation 38. Diverter 28, attached to production tubing 26, is used as a kickoff point for jet bit 20 to turn 90 degrees or a selected angle from vertical well 14 into formation 38. Diverter 28 may turn the jet bit from 20 to 130 degrees within the diverting path. Well 14 typically will have steel casing 16 that has a surrounding layer of cement 18 to hold it in place. Jet bit 20 is connected to the distal end of flex hose 22. Flex hose 22 may range in size from ¼-inch to 1-inch in outside diameter. Flex hose 22 is connected to the distal end of work string 24 at connector 23, which is usually coiled tubing, as illustrated, but may be jointed tubing. Flow can be conveyed from pump 34 at surface to jet bit 20 downhole to perform jet drilling operations. Diverter 28 is placed on the lower end of production tubing 26 at the depth where drilling is to be conducted.

Figure 2:
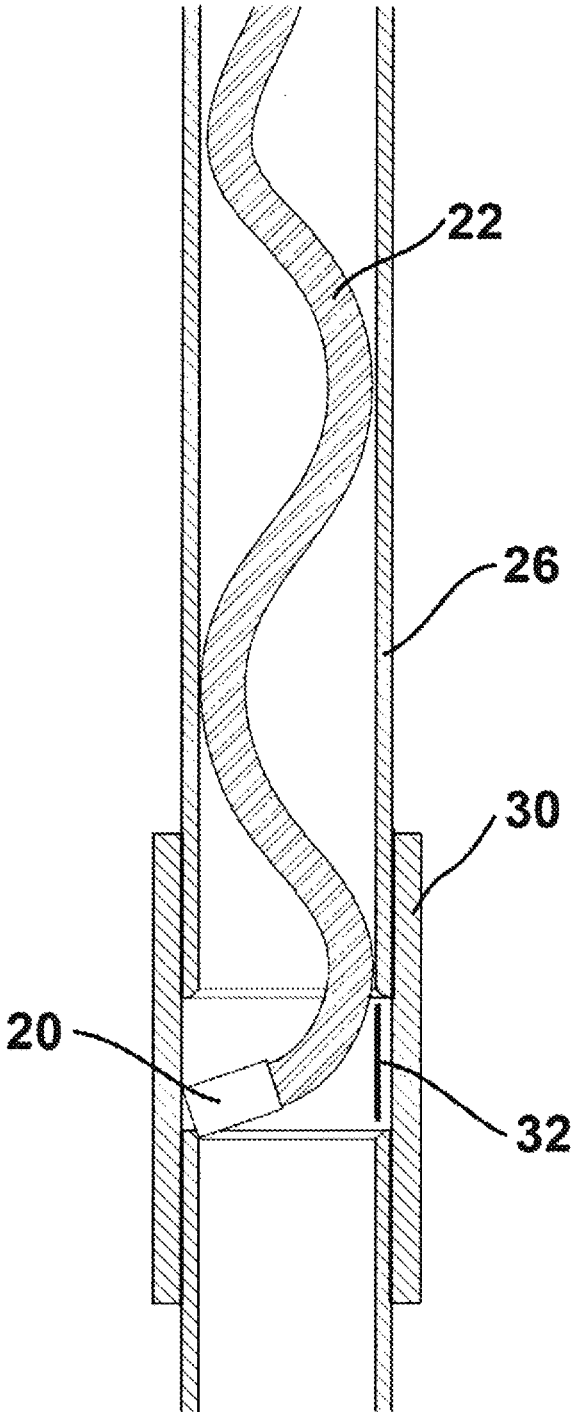
FIG. 2 illustrates the concept of helical buckling of a hose and a jet bit being caught within gaps inside production tubing.

FIG. 2 shows how jet bit 20 can catch in production tubing 26 at coupler or collar 30, where two sections (joints) of production tubing 26 come together. There can be as much as a 2-inch gap across coupler gap 32 where jet bit 20 could catch and turn. Once the distal end of hose 22 is stopped, hose 22 would then begin to buckle and create excessive drag between flex hose 22 and production tubing 26. If the axial force is further increased on flex hose 22 the buckling would then become helical buckling and eventually lead to lockup. Lockup is defined when the drag force exceeds the axial force applied to the flex hose 22. This can prevent the bottom hole assembly from reaching the diverter. Continuing to apply force can damage flex hose 22.

The theory of buckling of coiled tubing in a well casing or hose within another tubular is well known. A specific example through testing by the inventors is given below. Whereas a stainless steel braid hose of 0.40 inch outside diameter, that is 20 feet in length, with an internal pressure of 8,000 psi is enclosed in a stainless steel tubular with an inner diameter of 1.12 inch. Table 1 has the axial forces exerted on the upper end on the pressurized hose and the axial force produced at the bottom of the pressurized hose across the 20 foot length.

TABLE 1

| Upper Axial Force (LBS) | Lower Axial Force (LBS) |
|---|---|
| 23 | 6.4 |
| 42 | 28 |
| 61 | 40.4 |
| 81 | 46 |
| 99 | 45 |
| 120 | 44.5 |
| 140 | 44.3 |
| 159 | 43.3 |
| 184 | 43.5 |
| 200 | 43 |
| 220 | 43 |
| 240 | 43 |

Note that with an upper axial force of 42 lbs. applied at the top yields a lower axial force of 28 lbs. at the bottom. Also, observe that once the applied upper axial force exceeds 99 lbs., the hose's buckling is such that lockup occurs in the tubular and no additional force is exerted at the lower end. Hence, if it takes a force above the buckling force for the jet bit and hose to pass through the diverter, the hose will just buckle and lock up in the tubing. A helically buckling segment will want to expand outwards adding to the frictional forces acting against the constraining outer tube, a normal force for the continuous length of the hose in contact. To decrease drag from buckling one can increase the hose bending stiffness and decrease radial clearance. Also, it is best that the inner surface of the pipe be smooth like stainless steel or other slick surfaces.

Further tests were conducted with different flex hoses that had varying diameters and bend-radius ratings. These variables all affect the buckling tendencies of flex hoses. Bend radius is one form of measurement of the flex hose's bending stiffness. Typically, in coiled tubing calculation a segment's bending stiffness is shown with the steel's Young's Modulus and the moment of inertia. Not being made of one continuous material, a flex hose's bending stiffness is hard to standardize, but for an example, a flex hose that has a 5-inch bend radius will have less tendency to buckle than a flex hose that has a 2.5 inch bend radius having the same diameter. The theory of buckling of tubing of hose within another tubular predicts that the normal force due to helical buckling is directly proportional to the radial clearance, $r_c$ and inversely proportional to bending stiffness, EI. Therefore, reducing the diameter of larger tubing around the flexible tubing, forming a "close-fitting" tubular system, can be used to decrease resistance to movement of the flexible tubing through the larger tubing.

A typical jet drilling setup would use 2⅜" production tubing, with about a 2-inch inner diameter and a flex hose of a similar size in the previous example. Since the radial clearance would be greater, the helical buckling of the flex hose would be created at a significantly lower force than the 99 lbs. in the example for lockup to occur.

Figure 3A:
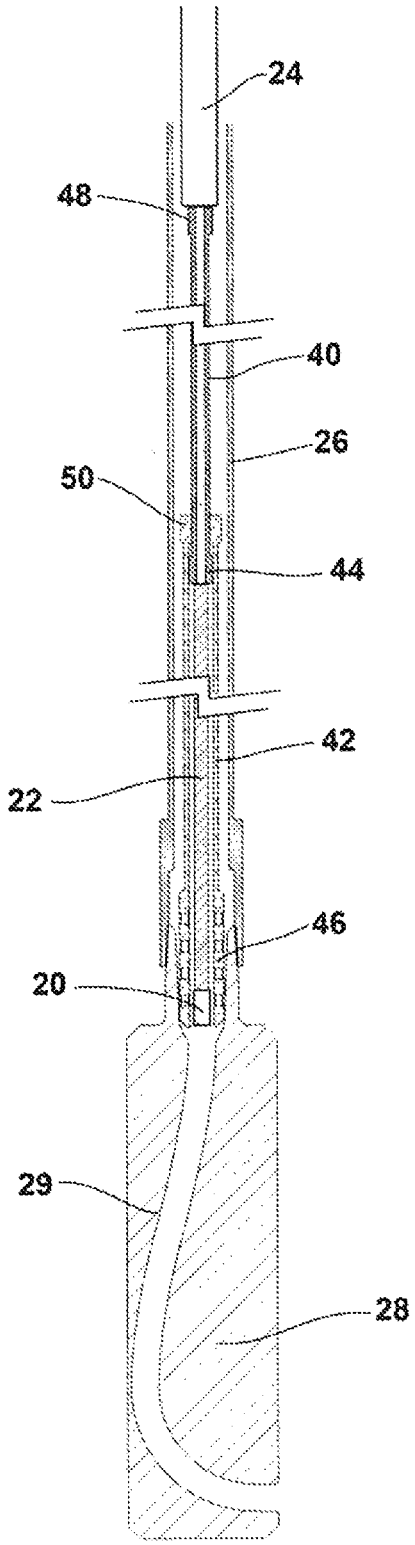
FIG. 3A and 3B illustrate how a jet bit delivery system encloses a hose and jet bit and how it would travel as a jet bit and hose as a drainhole is drilled.

Referring to FIG. 3, one embodiment of a close-fitting tubular system disclosed herein is shown. In FIG. 3A, outer pipe piece 42 encapsulates flex hose 22, preventing the catching of the hose in sharp transitions (not shown) in production tubing 26. At the distal end of the outer pipe 42 perforated stinger 46 may be placed; this perforated stinger 46 is designed such that it engages with diverter 28 to give a smooth transition into the diverter path 29. At the upper end of the outer pipe piece 42 is an outer pipe piece upper transition 50 Inner pipe piece 40 operates within outer pipe piece 42. At the distal end of inner pipe piece 40 is flex hose or tubing 22. The proximate end of inner pipe piece 40 is connected to the distal end of work string 24; this allows inner pipe piece 40 to convey pressure and flow from work string 24 to flex hose 22. Inner pipe piece 40 has an inner pipe piece upper transition 48 and an inner pipe piece lower transition 44. Inner pipe piece 40 is free to move downward until upper transition 48 reaches outer pipe piece upper transition 50. Inner pipe piece 40 is free to move upward until inner pipe piece lower transition 44 reaches outer pipe piece upper transition 50. Therefore, work string 24 is used to lower flexible tubing 22 and all other apparatus attached to work string 24 into a well.

During a jet drilling operation, during placement of the apparatus in a well, the close fitting tubular system illustrated in FIG. 3A will keep flex hose 22 contained until stinger 46 engages the top of diverter path 29. Weight may be added to outer pipe piece 42 such that when it engages diverter 28 it can be more easily observed on a weight indicator at surface when the pipe piece contacts the diverter and there is a decrease in the string weight. This confirms the location of the bottom-hole assembly. Then pressure and flow can be applied to work string 24, which would then be conveyed through inner pipe piece 40 and flex hose 22 to jet bit 20 for jet drilling. Inner pipe piece 40 and flex hose 22 will then continue to move within stationary outer pipe piece 42 until inner pipe piece upper transition 48 reaches outer pipe piece upper transition 50.

Figure 3B:
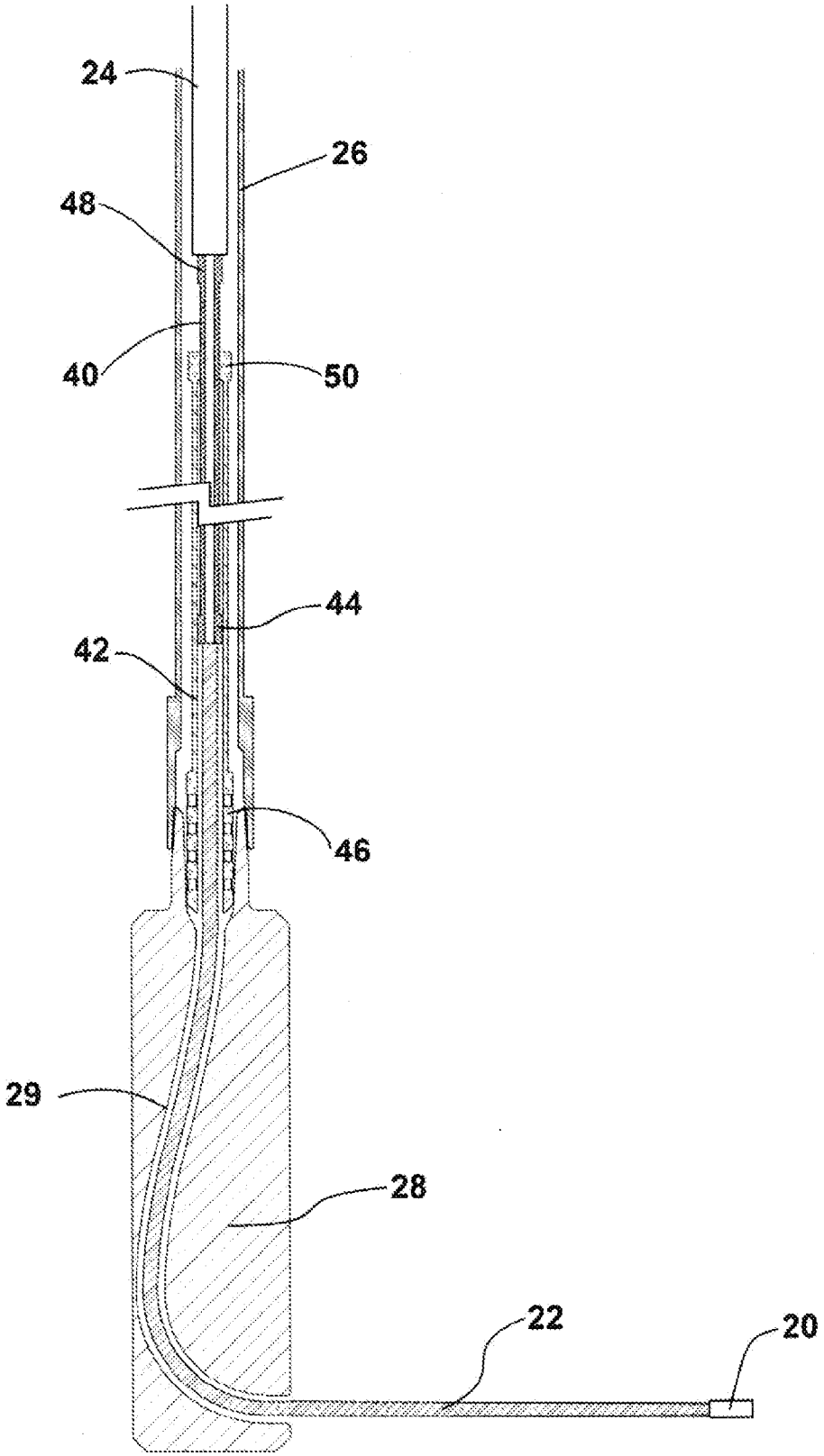

Illustrated in FIG. 3B, jet bit 20 has exited diverter 28 and drilled out into a rock formation, creating a lateral or drain hole. The length of the lateral will be limited by the travel of inner pipe piece 40, restricted by the inner pipe piece upper transition 48 and the outer pipe piece upper transition 50 and the length of flex hose 22. Outside pipe piece 42 remains stationary above the diverter while flexible hose 22 with bit 20 and inside pipe piece 40 move downward and jet drill a lateral.

Force can be transmitted from work string 24 through inner pipe piece 40 and flex hose 22 to overcome friction forces in diverter path 29. Because of the smaller ID of outer pipe piece 42 than that of production tubing 26, the radial clearance of flex hose 22 is less and therefore less drag will occur in outer pipe piece 42 than in previous tubing configurations. The surface of outer pipe piece 42, of flexible hose 22 and of diverter path 29 may be formed from a low-friction material, which may be a solid liner or a coating applied to the surface. One low-friction material is TEFLON.

Figure 4:
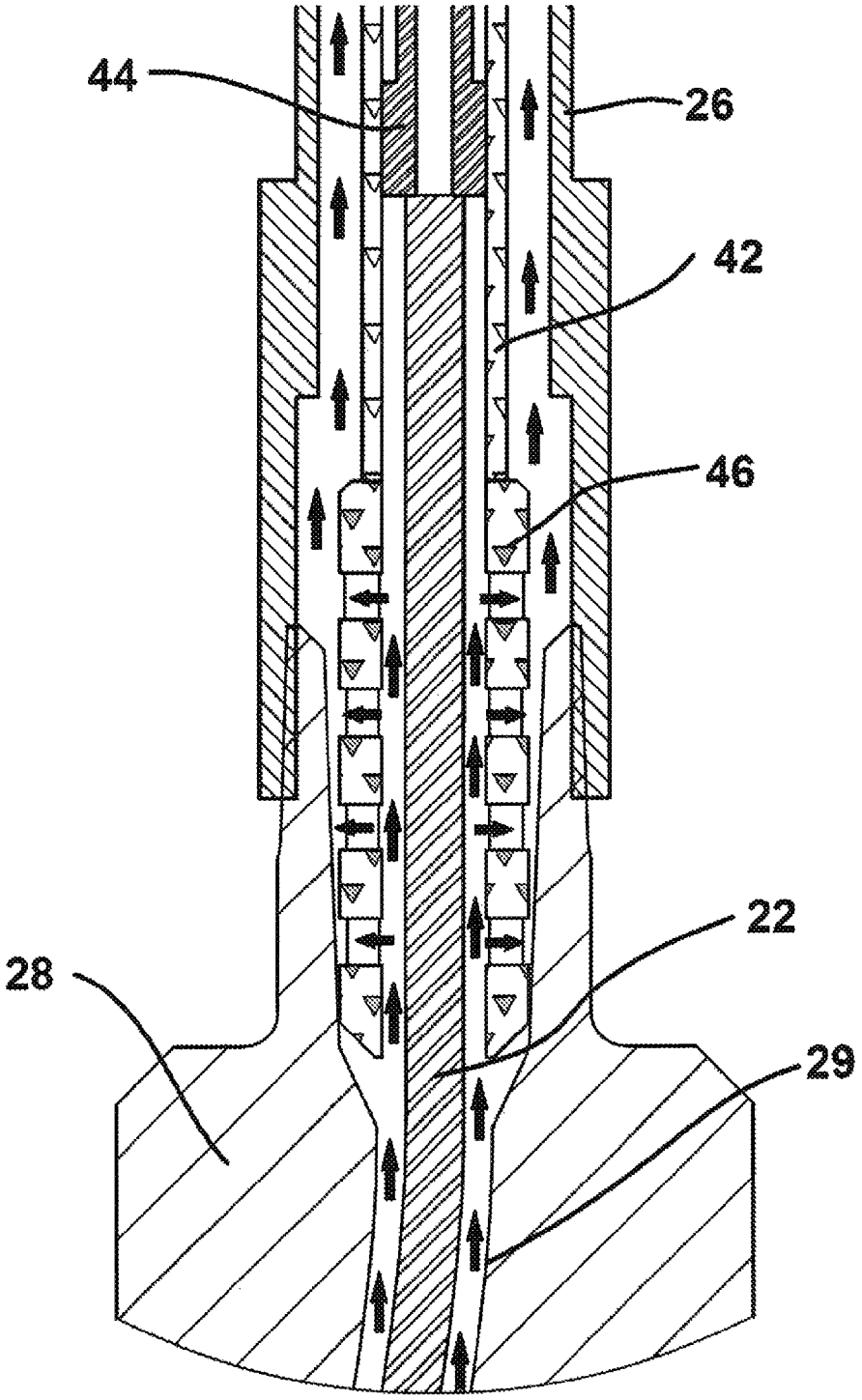
FIG. 4 illustrates fluid flow directed through a stinger and around the jet bit delivery system.

In FIG. 4, fluid flow is illustrated by arrows through perforated stinger 46 and continuing up production tubing 26. Fluid containing rock cuttings from jetting has been known to circulate up and through diverter path 29 into production tubing 26. The perforations in perforated stinger 46 allow this natural flow path to continue and also restricts fluid from flowing up into outer pipe piece 42 and inner pipe piece lower transition 44.

Figure 5:
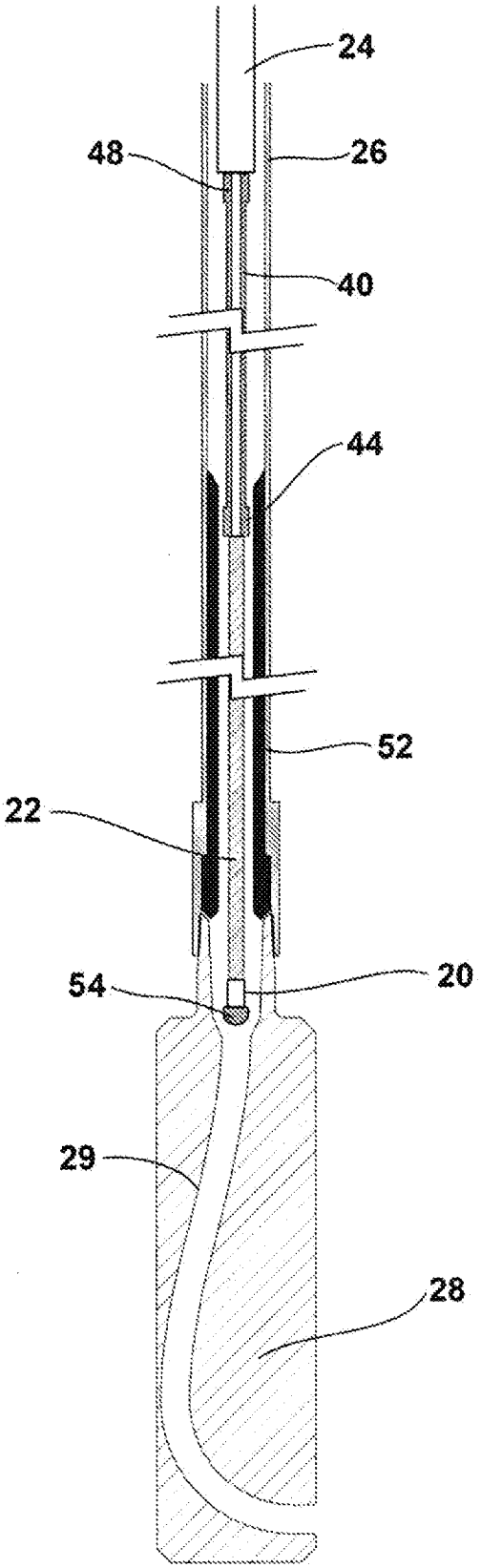
FIG. 5 illustrates an alternative design where a restriction (liner) is placed in the production tubing immediately above the diverter to provide a narrow path, which enables greater downward force transmission through a hose to a jet bit.

In FIG. 5, another embodiment of a close-fitting tubular system restricting the buckling of flex hose 22 to allow greater force transfer by utilizing a tubing liner or smaller ID tubular 52 (hereinafter referred to as a liner) is illustrated. This enables greater force from work string 24 to be transferred through smaller pipe piece 40 to flex hose 22 and jet bit 20 to jet drill the lateral using diverter 28 attached to production tubing 26. Smaller pipe piece 40 with transitions 44 and 48 may be omitted and work string 24 may be attached directly to flexible hose 22 if the diameter of work string 24 is small enough to pass through liner 52. Tubing liner or smaller ID tubing 52 preferably has an internal diameter less than 1 inch greater than the external diameter of flexible hose 22. "Soluble ball" 54 can be placed on the end of a jet bit 20 before the bit and flex hose 22 are lowered down the tubing. Ball 54 may be made of a material that is slowly soluble in water or a polymer material that degrades in water. Jet bit 20 will not catch on tubing connections with the rounded front of ball 54. Once jet bit 20 is to the diverter or before drilling commences, pressure may be applied to blast off ball 54, which then dissolves or degrades.

While the preferred embodiments directed in this invention have been discussed herein, further modifications to the preferred embodiments will occur to those skilled in the art and such modifications are included in the scope of this invention. Although the present invention has been described with respect to specific details, it is not intended that such details should be regarded as limitations on the scope of the invention, except to the extent that they are included in the accompanying claims.

We claim the following:

1. Apparatus for drilling drain holes from a well, comprising:

a diverter for directing a flexible tubing, the diverter being adapted for attachment to a production tubing in the well and having a diverter path therethrough;

a flexible tubing having an outside surface and being adapted for joining to a jet bit at a distal end and being attached to an inner pipe piece at a proximate end, the inner pipe piece having an upper transition adapted for joining to a work string and a lower transition adapted for joining to the flexible tubing;

an outer pipe piece, the outer pipe piece having a proximate transition adapted for stopping separation of the inner pipe piece and the outer pipe piece and a distal end; and a soluble body having a rounded front attached to the jet bit.

2. The apparatus of claim 1 wherein the outer pipe piece further includes a stinger attached at the distal end.

3. The apparatus of claim 2 wherein the stinger includes holes for allowing flow through the stinger from the outer pipe piece.

4. The apparatus of claim 2 wherein the surface of the diverter path, the inner pipe piece or the outside surface of the flexible tubing is configured to reduce a frictional drag.

5. The apparatus of claim 1 whereas the difference in outside diameter of the flexible hose and inside diameter of the outer pipe piece is in the range from 0.05 inch to 2 inch.

6. The apparatus in claim 1 whereas the length of the outer pipe piece is greater than the length of the flex hose and jet bit.

7. Apparatus for drilling drain holes from a well, comprising:

a diverter for directing a flexible tubing, the diverter being adapted for attachment to a distal end of a production tubing;

a flexible tubing having an outside diameter and surface, the flexible tubing being adapted for attachment to a work string at a proximate end of the flexible tubing;

a jet bit attached at a distal end of the flexible tubing;

a liner adapted for placement in proximity to the distal end of the production tubing, the inside diameter of the liner being in the range from 0.05 inch to 1.2 inch greater than the outside diameter of the flexible tubing; and a soluble body having a rounded front attached to the jet bit.

8. The apparatus of claim 7 further comprising an inner pipe piece disposed between the work string and the flexible tubing.

9. A method for drilling a drain hole from a well, comprising:

placing a production tubing and a diverter in the well, the production tubing having the diverter attached to a distal end, the diverter having a diverter path for directing a flexible tubing in the well;

placing the flexible tubing having a bit attached thereto, an inner pipe piece and an outer pipe piece into the production tubing, the flexible tubing being attached to the inner pipe piece, the inner pipe piece having an upper transition and a lower transition and being moveable inside the outer pipe piece, the outer pipe piece having an outer pipe piece upper transition adapted for stopping separation of the inner pipe piece within the outer pipe piece;

connecting the inner pipe piece to a work string adapted for lowering through the production tubing in the well;

lowering the work string into the well to place the outer pipe piece on the diverter;

pumping fluid through the work string while lowering the work string to drill the drain hole; and placing a degradable ball over into the work string and flexible tubing into the production tubing.

10. The method of claim 9 further comprising measuring the weight of the work string at the surface to determine when the outer pipe piece contacts the diverter.

11. The method of claim 9 further comprising placing a material on a surface on the diverter path or on the flexible tubing or the inner pipe piece before placing in the production tubing, wherein the material is configured to reduce a frictional drag.

12. The method of claim 9 further comprising pumping fluid containing an additive for reducing metal-to-metal friction.

13. A method for drilling a drain hole from a well, comprising:

placing a liner in a segment of production tubing, attaching a diverter having a diverter path to the segment of production tubing and placing the production tubing in the well;

attaching a flexible tubing to a work string, placing a bit on the flexible tubing and placing the work string and flexible tubing into the production tubing;

lowering the work string into the well to move the bit through the diverter;

pumping fluid through the work string while further lowering the work string to drill the drain hole; and placing a degradable ball over the bit before placing the work string and flexible tubing into the production tubing.

14. The method of claim 13 further comprising placing an inner pipe piece between the flexible tubing and the work string.

15. The method of claim 13 further comprising placing a material on a surface of the flexible tubing or the diverter path before placement in the well, wherein the material is configured to reduce a frictional drag.

16. The method of claim 13 further comprising pumping fluid containing an additive for reducing metal-to-metal friction.

* * * * *